United States Patent [19]

Dyjak

[11] 4,074,650

[45] Feb. 21, 1978

[54] EXPENDABLE LIGHT-WEIGHT MINESWEEPING CUTTER

[75] Inventor: Richard C. Dyjak, Panama City, Fla.

[73] Assignee: The United States of America as represented by the Secretary of the Navy, Washington, D.C.

[21] Appl. No.: 272,810

[22] Filed: Apr. 12, 1963

[51] Int. Cl.[2] ..... B63B 9/00

[52] U.S. Cl. ..... 114/221 A

[58] Field of Search ..... 114/221 A; 89/1 B; 42/1

[56] References Cited

U.S. PATENT DOCUMENTS

| | | | |
|---|---|---|---|
| 1,312,405 | 8/1919 | Lander | 114/221 A |
| 3,020,871 | 2/1962 | Temple et al. | 114/221 A |

*Primary Examiner*—Verlin R. Pendegrass
*Attorney, Agent, or Firm*—Louis A. Miller; Rolla N. Carter

EXEMPLARY CLAIM

1. In an underwater mine cable cutter of the cartridge-chisel type adapted to be pulled forwardly through the water by a sweep line provided with a cutter stop
   - a stabilizing fin having a front edge adapted to lie along a sweep line,
   - an abutment formed on said fin for engaging a cutter stop,
   - a frame member having an axis,
   - said frame member having a sweep line-receiving recess parallel to said axis
   - means for detachably connecting said frame member to said fin with the front edge of said fin closing the entrance to said recess,
   - said connecting means including shearable means the shearing of which releases said frame from said fin,
   - the abutment on said fin being spaced in said axial direction from a portion of said frame member by a distance sufficient to permit the shearing of said shearable means and thereafter be engaged by said frame member to resist further recoil thereof, and
   - explosively driven cable cutting means so arranged in said frame member that recoil in the axial direction from a cable cutting explosion causes the shearing of said shearable means to release said frame member from said fin.

1 Claim, 4 Drawing Figures

INVENTOR.
RICHARD C. DYJAK
BY
Roger M. Carter
ATTORNEYS

EXPENDABLE LIGHT-WEIGHT MINESWEEPING CUTTER

The invention described herein may be manufactured and used by or for the Government of the United States of America for governmental purposes without the payment of any royalties thereon or therefor.

The present invention relates to improvements in cable cutting devices and more particularly to such devices of the explosive type employed for severing the anchoring cables of moored submarine mines.

In one presently used system the sweeping of moored mines is accomplished by towing a suitable depth a sweep line or wire on which are mounted devices which when a mooring cable or chain is encountered are triggered to cut the cable, these devices being maintained at spaced intervals by stop members secured to the sweep line. Cutter devices presently in use are built to be rearmed for reuse and accordingly are constructed of materials to withstand the recoil of the explosive cartridge which results in their being both heavy and expensive.

It is an object of the present invention to provide a cable cutting device which is very light in weight and inexpensive enough to be considered expendable.

Another object of the invention is to provide such a cable cutter of the explosive type which when actuated will jettison from the sweep line to reduce weight and drag as well as eliminate any impediment to a mine mooring cable subsequently sliding along the sweep line.

Another object of the invention is to provide such a cable cutter which in the event of a misfire will be freed from the sweep line by the force imposed by the drag of a mooring cable.

Still another object of the invention is to provide a cable cutter the components of which are readily adaptable to mass production techniques.

Figure 1:
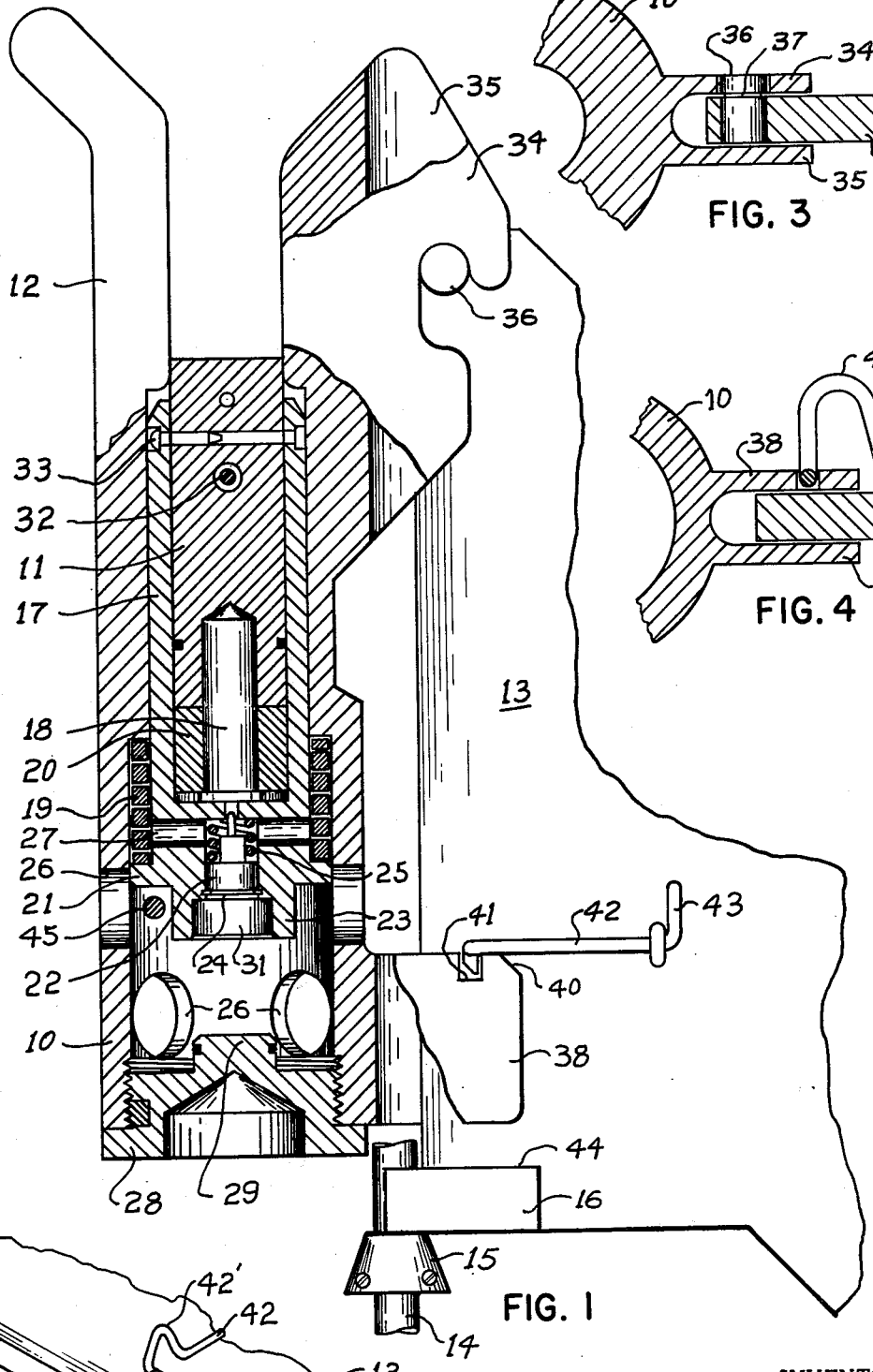
Figure 3:
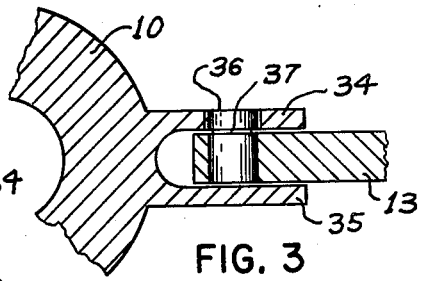
Figure 4:
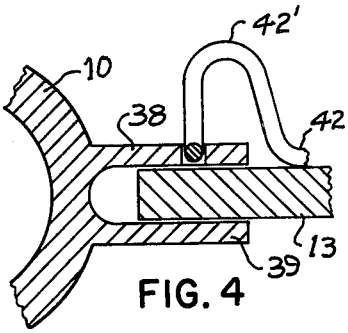
Figure 2:
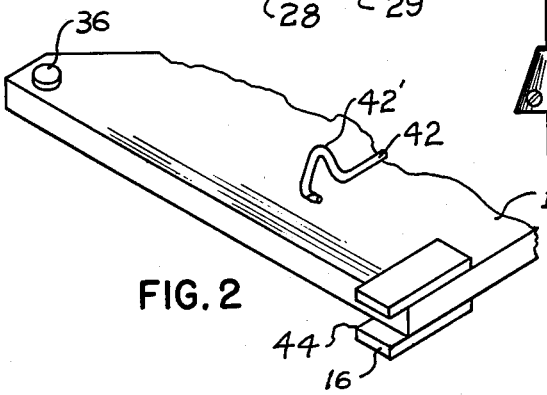

Other objects of the invention as well as the invention itself will be understood from the following description when read in connection with the accompanying drawing in which FIG. 1 is a cutting device mounted with its stabilizing fin on a sweep wire, FIG. 2 is a fragmentary view in perspective of the stabilizing fin, and FIGS. 3 and 4 are, respectively, fragmentary views of the sweep line-receiving configuration of the cutter frame and fin assembly.

The cutter device per se incorporates the same operating principle as does the cutter device described and claimed in patent application Ser. No. 237,765, filed Nov. 14, 1962, and now U.S. Pat. No. 3,326,172, by Louis A. Kish, and assigned to the assignee of the present applicaion. In use, the cutting devce is mounted on the sweep line in such manner that its explosively driven chisel is parallel to the line and has its cutting edge facing in the direction of tow so that when a mooring cable is encountered, pressure against the edge of the chisel shears a trigger pin which initiates a firing operation. In accordance with the invention, when the cutter fires the chisel is driven forward to cut the mooring cable and at the same time the cutter frame is driven aft with respect to the stabilizing fin which relative movement shears the connection between the cutter and the fin after which the cutter body strikes an abutment on the fin provided for the purpose of resisting further recoil. The cutter body and fin then separate and leave the sweep line. In the event of a misfire, the shearable connecting means between the cutter body and the fin shears when a tension considerably higher than the tension required for firing is developed in a mooring cable thereby permitting the cutter body and the fin to separate and leave the sweep line.

The embodiment of the invention illustrated in the drawing comprises a cutter housing or frame member 10 having a forwardly facing chisel 11 against which a mine mooring cable is directed by a cable guide 12. The housing 10 and a stabilizing fin 13 are assembled around a sweep wire 14 so as to be rotatably mounted thereon. A tapered collar 15 clamped to the wire 14 serves as a cutter stop which bears against an abutment 16 provided on the aft end of the fin 13 to keep the frame member 10 from sliding outwardly along the wire 14. A barrel 17 having a center bore in which the chisel 11 and a cartridge 18 are axially alined fits with sliding engagement in the forward section of the housing 10 of reduced diameter which provides a rearwardly facing internal shoulder constituting a bearing surface for a firing spring 19 surrounding the barrel 17 and engaging a flange 21 formed on the barrel 17. A bushing 20 surrounding the lower portion of the cartridge 18 prevents rupture of a cartridge 18 in its primer area and also limits the extension of the cartridge 18 into the chisel 11 to achieve greater driving force. A firing piston 22 is held in axial alinement with the cartridge 18 by a cylindrical breech block 23 formed near the aft end of the barrel 17 and is held in place therein by a retaining ring 24 against which the piston 22 is resiliently held by a compressed spring 25 and thus out of engagement with the cartridge 18. The cutter housing 10 is free flooding through openings 26 provided therein. Radial passageways 27 in the breech block 23 permits fluid displacement when the firing piston 22 moves forward. A base member 28 closing the rear end of the housing 10 is provided with a boss 29 dimensioned to mate with a well 31 provided in the rear end of the breech block 23 so that when the well 31 is filled with a liquid, rapid movement of the well 31 over the boss 29 will move the piston 22 to firing position. With gas in the well 31, the firing piston 22 will not be actuated as a result of such movement of the well 31.

The barrel 17 normally is held in the cocked position shown, with the spring 19 compressed, by means of a trigger pin 32 extending through the housing 10, through the barrel 17, and perhaps into the chisel 11. A lock pin 33 extends through the barrel 17 and into the chisel 11 for holding the chisel 11 in the barrel 17. When a mine cable presses against the chisel 11 with a force sufficient to shear the trigger pin 32 between the housing 10 and the barrel 17 the spring 19 forces the water filled hollow rear end 31 of the breech block 23 over the boss 29 thereby actuating the firing piston 22. The force of the explosion of the cartridge 18 builds up to cause the chisel 11 to shear the lock pin 33 between the chisel 11 and the barrel 17 (also to shear the pin 32 if present) and then moves forward to cut the mine cable held taut against the chisel 11 by the drag of the mine and its anchor.

In order that another mine cable will not be hooked after the cutter has fired, the invention makes provision for the firing action of the cutter to bring about the jettisoning of the entire cutter assembly, i.e., the cutter frame 10 and its stabilizing fin 13. One arrangement suitable for this purpose is shown in the drawing wherein the frame member 10 is provided with a sweep line-receiving recess substantially parallel to the axis of the bore of the frame 10 and formed at the forward end by a pair of protruding ears 34 and 35 spaced apart for receiving the leading front edge of the fin 13, at least one of said ears, e.g., ear 34, being provided with a rearwardly facing hook portion adapted to engage a fin stop 36 rigidly secured in and projecting above the surface of the fin 13. The fin stop 36 may be provided with a region of reduced diameter 37 for selecting the force at which the fin stop 36 will shear. The aft end of the line-receiving recess is similarly formed by a pair of protruding ears 38 and 39 spaced apart for receiving the front edge of the fin 13. At least one of said ears, e.g., ear 38, is provided with a forwardly facing notch 41 adapted to receive the distal end of a spring latch 42 having its proximal end 43 rigidly secured to the fin 13 in any suitable manner. An inclined edge 40 is provided on the ear 38 for camming latch 42 into the notch 41 when the housing 10 is assembled on to the fin 13 by first hooking the ear 34 on to the fin stop 36 and then rotating the housing 10 counterclockwise about the fin stop 36 into the assembled position shown in FIG. 1. The spring latch 42 is preferably provided near its distal end with a part 42' bowed away from the surface of the fin 13 to facilitate disengaging the latch 42 from the notch 41 as by thumb pressure.

It will be noted from the foregoing that when the housing 10 and the fin 13 are assembled as described and with the sweep line 14 in the recess formed by the respective pairs of ears, 34 and 35, 38 and 39, the cutter assembly will be freely rotatable on the wire 14 and can move lengthwise of the wire. In its operating position the abutment 16 engages the cutter stop 15 to position the cutter assembly lengthwise of the wire 14. When assembled the forward facing edge 44 of the abutment 16 is spaced from the ears 38 and 39 by a small distance such that rearward movement of the cutter housing 10 will not be impeded by the abutment 16 until after the fin stop 36 has sheared and the notch 41 has receded from the latch 42. Thereafter the ears 38 and 39 engage the abutment 16 which as backed by the stop 15 provides reaction to the recoil forces. With the fin stop 36 sheared and the latch 42 disengaged the entire cutter assembly wll fall clear of the sweep wire 14 leaving this point clear for additional mooring cables contacted to pass down the sweep wire 14 to the next cutter. In the event the cartridge 18 misfires, the force of the mooring cable will increase to the point where the fin stop 36 will shear thereby freeing the sweep from the mooring cable. In an exemplary embodiment the triggering pin 32 was designed to shear when a mooring cable exerted a force of approximately 500 pounds against the chisel 11. Thereafter in the event of a misfire, the fin stop 36 was designed to shear when a force of approximately 1,000 pounds.

The cutter is cocked by moving the barrel 17 forward against the compression of the firing spring 19 by any suitable tool (not shown). When in cocked position the trigger pin 32 is inserted through the housing 10, the barrel 17, and into the chisel 11. It is to be understood that the extension of the pin 32 into the chisel 11 is nonfunctional but a matter of convenience in not requiring a critical short length for the trigger pin 32 and it is for this reason that the hole in the chisel 11 is shown larger than the pin 32. Also, when in cocked position, a safety pin 45 is inserted in holes through housing 10 with the position of the pin within the housing directly behind the flange 21 on the barrel 17. The safety pin 45 is not removed until the cutter is about to be lowered into the water.

It will be understood that one manner in which the cable cutter of the invention may be utilized in a sweeping operation is to secure the cutter at spaced intervals along a sweep wire adapted to be towed by a mine sweeping vessel as illustrated in FIG. 2 of U.S. Pat. No. 2,910,034, issued to J. Sullivan, Oct. 27, 1959. Also when the array is under tow, the stabilizing fin trails the sweep wire 14 in a substantially horizontal plane so as to position the cutter frame 10 to receive any mooring cable guided against it by the sweep wire 14.

While for the purpose of disclosing the invention a preferred embodiment thereof has been described in detail it is to be understood that the invention is nt limited thereto and that modifications obvious to those skilled in the art are intended to be included within the scope of the appended claims.

What is claimed is:

1. In an underwater mine cable cutter of the cartridge-chisel type adapted to be pulled forwardly through the water by a sweep line provided with a cutter stop a stabilizing fin having a front edge adapted to lie along a sweep line, an abutment formed on said fin for engaging a cutter stop, a frame member having an axis, said frame member having a sweep line-receiving recess parallel to said axis means for detachably connecting said frame member to said fin with the front edge of said fin closing the entrance to said recess, said connecting means including shearable means the shearing of which releases said frame from said fin, the abutment on said fin being spaced in said axial direction from a portion of said frame member by a distance sufficient to permit the shearing of said shearable means and thereafter be engaged by said frame member to resist further recoil thereof, and explosively driven cable cutting means so arranged in said frame member that recoil in the axial direction from a cable cutting explosion causes the shearing of said shearable means to release said frame member from said fin.

* * * * *